United States Patent [19]

Tate et al.

[11] Patent Number: 4,670,129

[45] Date of Patent: Jun. 2, 1987

[54] PITCH FOR PRODUCTION OF CARBON FIBERS

[75] Inventors: Kazuhito Tate; Hajime Yoshida; Kazuhiro Yanagida, all of Kanagawa, Japan

[73] Assignee: Mitsubishi Oil Co., Ltd., Tokyo, Japan

[21] Appl. No.: 853,579

[22] Filed: Apr. 18, 1986

[30] Foreign Application Priority Data

Apr. 18, 1985 [JP] Japan ..... 60-81384
Oct. 2, 1985 [JP] Japan ..... 60-218078

[51] Int. Cl.[4] ..... C10C 3/06; D01F 9/20

[52] U.S. Cl. ..... 208/22; 208/39; 208/44; 264/29.2; 423/447.4; 528/247; 585/11; 585/426

[58] Field of Search ..... 208/40, 44, 39, 22; 423/447.1, 447.4; 264/29.2; 585/11, 426; 528/247

[56] References Cited

U.S. PATENT DOCUMENTS

| | | | |
|---|---|---|---|
| 2,548,982 | 4/1951 | Kemp | 585/426 |
| 2,597,159 | 5/1952 | May et al. | 528/247 |
| 2,660,572 | 11/1953 | Feasley | 528/247 |
| 2,957,851 | 10/1960 | Fetterly | 528/247 |
| 4,032,430 | 6/1977 | Lewis | 208/39 |
| 4,317,809 | 3/1982 | Lewis et al. | 423/447.2 |

*Primary Examiner*—P. E. Konopka
*Attorney, Agent, or Firm*—Sughrue, Mion, Zinn, Macpeak & Seas

[57] ABSTRACT

A pitch having optical anisotropy for use in production of carbon fibers, wherein the pitch is prepared using a compound represented by the formula (I) as a raw starting material and subjecting the compound to thermal modification and then removing light fractions

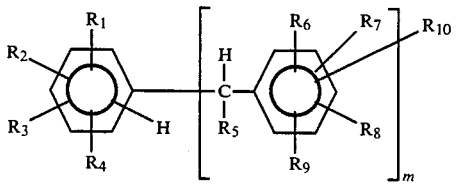

(I)

wherein $R_1$, $R_2$, $R_3$, $R_4$, $R_6$, $R_7$, $R_8$, $R_9$ and $R_{10}$ each represents a hydrogen atom or a methyl group or an ethyl group; $R_5$ represents a hydrogen atom or a methyl group; the total number of carbon atoms of $R_1$, $R_2$, $R_3$ and $R_4$ is from 2 to 4 and the total number of carbon atoms of $R_6$, $R_7$, $R_8$ and $R_9$ is from 2 to 4; and m is at least 3. The pitch is substantially homogeneous in quality, has a low softening point and has excellent molecular orientation.

21 Claims, No Drawings

PITCH FOR PRODUCTION OF CARBON FIBERS

FIELD OF THE INVENTION

The present invention relates to a pitch having excellent properties as a raw material for production of carbon fibers of high strength and high modulus of elasticity (high quality carbon fibers), and other carbon materials. More particularly, it is concerned with an optically anisotropic pitch which is prepared by using as a raw material a compound comprising four or more alkylbenzenes bound together through a methylene group and subjecting the raw material to thermal modification, and which is substantially homogeneous in quality, has a low softening point, and has excellent molecular orientation.

BACKGROUND OF THE INVENTION

In general, carbon fibers are produced industrially mainly from rayon, PAN (polyacrylonitrile) or pitch. PAN, however, has disadvantages in that it is expensive and the carbonization yield is low. On the contrary, pitch is inexpensive and thus is attractive from an economic standpoint. Of pitch materials, an isotropic pitch cannot provide high quality carbon fibers because of its poor orientation. On the contrary, carbon fibers produced from an optically anisotropic pitch called a mesophase pitch have a highly oriented structure in which carbon crystallites are preferentially aligned parallel to the fiber axis and thus have excellent mechanical characteristics, that is, high strength and high modulus of elasticity.

Therefore, extensive investigations are being made on the production of a mesophase pitch as a raw material for production of high quality carbon fibers, from a catalytic cracking residue of oil, a naphtha tar pitch or a coal tar pitch. It has been confirmed by many experiments that molecules composed mainly of polycondensed aromatics are orientated in the direction of the fiber axis and thus high quality carbon fibers can be obtained from the mesophase pitch. The mesophase pitch, however, has disadvantages in that the viscosity is high and thus the softening point is high because of the interaction of polycondensed aromatics. For this reason, various investigations have been made to improve the spinning properties of the mesophase pitch by lowering its softening point. When, however, a complicated mixture such as a petroleum pitch or a coal tar pitch is used as a raw material and is subjected to thermal modification for the purpose of developing a polycondensed aromatic structure, the resulting pitch inevitably has a continuous and wide distribution of molecular weight. Therefore, if such a complicated non-homogenous mixture is used as a raw material, it is difficult to control the chemical structure of the product pitch and thus to selectively produce a pitch having a significantly lower softening point. It is generally said that the spinning temperature is 40° to 100° C. higher than the softening point. It has, therefore, been difficult to spin a mesophase pitch having high anisotropy at temperatures lower than 300° C. That is, in many cases, the mesophase pitch has been spun at temperatures as high as 340° to 380° C. At such high spinning temperatures, however, the mesophase pitch is liable to undergo thermal decomposition and a thermal condensation reaction, thereby producing gas and high molecular weight substances. Thus, it has been difficult to stably spin the mesophase pitch for long periods of time.

Various attempts have been made to overcome the above problems of the conventional mesophase pitch. Japanese Patent Publication No. 30192/84, for example, discloses a method of partially hydrogenating a mesophase pitch to appropriately weaken its laminated state and then spinning it as an isotropic pitch. Japanese Patent Application (OPI) No. 18421/83 (the term "OPI" as used herein refers to a "published unexamined Japanese patent application") discloses a method utilizing a specific premesophase pitch which is isotropic at the time of spinning but is converted into an anisotropic state at the stage of carbonization. In any method, however, the pitch is spun at an isotropic stage where the molecular orientation is poor. Therefore, inevitably, the orientation of molecules in fibers is poor as compared with that in an anisotropic pitch. Moreover, it cannot be said to be advantageous from an industrial standpoint to hydrogenate a viscous and carbonaceous material in which condensed polycyclic aromatic units are laminated.

Coal tar, naphtha tar or a fluid catalytic cracking residue of a petroleum fraction contains inorganic substances such as free carbon and catalyst powder. These substances not only make an obstacle to the spinning of the pitch, but also if contained in fibers in the form of fine particles, produce defects in the fibers and weaken their strength. Therefore, many methods of removing such inorganic substances have been developed. Japanese Patent Application (OPI) No. 167788/81 (corresponding to U.S. patent application Ser. No. 143,136 filed on April 23, 1980), for example, discloses a method which comprises subjecting a catalytic cracking residual oil to thermal soaking to obtain a pitch, extracting the pitch with a solvent to remove insoluble ash components such as cokes and finely divided catalyst particles, and then treating the resulting mass with an anti-solvent compound to precipitate an anisotropic pitch precursor. Japanese Patent Application (OPI) No. 164386/84 discloses a method comprising subjecting a coal tar pitch to refining by a two-step thermal modification wherein at the first step, a thermal modification is lightly performed until a small amount of mesophase spheres are formed, and at the second step finely divided free carbon having a size of not more than 1 micron and inorganic substances constituting an ash are all removed together with mesophase spheres by techniques such as filtration. In accordance with these methods, however, it is difficult to also remove submicron particles and, thus, the strength and the modulus of elasticity of carbon fiber cannot be increased.

SUMMRY OF THE INVENTION

An object of the present invention is to provide a highly optical anisotropic pitch which is prepared from a compound having the specified chemical structure and which has a lower softening point than that of the above mentioned conventional pitch, and which can be spun easily and stably at a much lower temperature than in the conventional mesophase pitch.

The above mentioned object of the present invention has now been accomplished by providing an optically anisotropic pitch which is prepared by using a compound of formula (I) comprising four or more alkylbenzenes bound together through a methylene group as a raw starting material and subjecting the compound to thermal modification and then removing light fractions. The compound (I) is as follows:

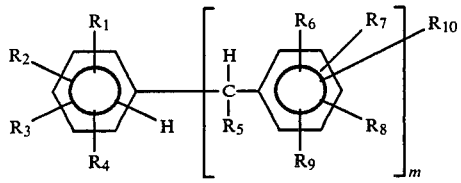

(I)

wherein $R_1$, $R_2$, $R_3$, $R_4$, $R_6$, $R_7$, $R_8$, $R_9$ and $R_{10}$ each represents a hydrogen atom or a methyl group or an ethyl group; $R_5$ represents a hydrogen atom or a methyl group; the total number of carbon atoms of $R_1$, $R_2$, $R_3$ and $R_4$ is from 2 to 4 and the total number of carbon atoms of $R_6$, $R_7$, $R_8$ and $R_9$ is from 2 to 4; and m is at least 3.

The subject of the present invention is to obtain highly optical anisotropic (85 to 100%) pitch with the properties of low softening point (180° to 280° C.), high hydrogen content (H/C=0.60 to 0.85) and high solvent solubility (toluene insoluble: lower than 50 wt %).

DETAILED DESCRIPTION OF THE INVENTION

The term "optical anisotropy" as used herein indicates an area where a light brightness is observed when a cross section of a pitch clump solidified at near room temperature is polished and examined under a crossed Nicol of a reflection type polarization microscope. The proportion of an optically anisotropic phase is determined based on such an area and indicated in percentage (%). "Toluene-insoluble content" and "quinoline-insoluble content" are determined by the methods specified in JIS-K-2425. "Softening point" indicates a temperature at which a pitch powder is observed to begin to deform when raised in temperature at a rate of 10° C./min in a nitrogen atmosphere by means of a hot stage type microscope.

The present invention provides a novel anisotropic pitch which is produced from low molecular weight compounds, is composed mainly of a toluene-soluble fraction and has a low softening point irrespective of its high optical anisotropy, and which can be spun at a much lower temperature than for the conventional mesophase pitch.

In order to produce the pitch as described above, it is necessary that a raw material having limited chemical structure be used and treated under sufficiently controlled conditions. As the raw material of the present invention, the compound of formula (I) set forth above is preferred. The benzene rings are bonded together via a methylene group while a methyl substituted methine group can be used in place of the methylene group. A compound which is bound together through longer alkylene groups than a methylene group or a methyl substituted methine group is not suitable for this invention. That is, it is a characteristic of the present invention that an optically anisotropic pitch which is prepared by using a compound comprising four or more alkylbenzenes bound together through a methylene group as a raw material is used. Although an anisotropic pitch can be produced from a compound of the structure wherein two or three alkylbenzenes are bound together, there is a defect that the yield is low and uneconomical.

Preferred examples of alkylbenzenes which constitute the compound of the present invention are benzene derivatives substituted by 2 to 4 alkyl groups. These compounds can be used alone or in combination with each other. It is considered that the length of the alkyl group as a side chain is preferred to be short from the viewpoint of the yield of anisotropic pitch. Moreover, an alkylbenzene having long side chain is not desirable in that the alkyl side chain undergoes thermal decomposition at the stage of thermal modification to produce a product the structure of which is different from the pitch. Therefore, a methyl group or an ethyl group is preferred as the alkyl groups. For example, alkylbenzene having 8 to 10 carbon atoms are obtained at a low cost and in a large amount from a catalytic reforming fraction in petrochemical industry. That is, the starting material of the present invention can be prepared from xylenes, trimethylbenzenes, tetramethylbenzenes, diethylbenzenes, etc., and their mixture. The raw material of the present invention as described above does not substantially contain inorganic substances such as free carbon and catalyst powder, unlike the coal tar pitch or catalytic cracking residue containing fine particles constituting the ash component, and thus is an excellent raw material from this point of view. Moreover, the starting material of the present invention is almost free of impurities such as sulfur because it is refined in the petrochemical industry. For this reason, anisotropy is well developed, troubles such as breaking during the spinning process are less likely, and properties that cause defects of the final carbon fibers are eliminated. Thus, the desired high fiber strength and modulus of elasticity can be obtained.

The compound of the present invention can be produced by polymerizing the above mentioned alkylbenzene. The alkylbenzene is reacted with formaldehyde and/or acetaldehyde in the presence of a protonic acid catalyst at 70° to 130° C. for 0.5 to 10 hours under mechanical stirring. A sulfuric acid, a phosphoric acid, a hydrochloric acid, perchloric acid or cation exchange resin of a strong acid type can be used as a protonic acid catalyst.

Formaldehyde or acetaldehyde can be used in any desired form as long as the aldehyde is released in a system where the polymer is prepared, that is, in any of formalin, paraformaldehyde, trioxane, and paraldehyde.

In addition, the compound of the present invention can be produced by polycondensation of a xyleneformalin resin or mesitylene-formalin resin with an alkylbenzene in the presence of protonic acid as a catalyst. Further, the compound can be produced by adding an alkylstyrene into an alkylbenzene in the presence of an acid catalyst. Although polymers produced by these methods can be utilized without further steps, the fraction containing alkylbenzene tetramers or higher oligomers as a raw material is preferred. This fraction is obtained by removing therefrom (e.g., distillation) compounds wherein only two or three alkylbenzenes are bound together. The pitch yield of these removed compounds is low.

Another important requirement is that the oxygen content of the compound used as the raw material is not more than 5 wt %, preferably not more than 2 wt %, and more preferably not more than 1 wt %. If the oxygen content is too large, the pitch is readily decomposed at the stage of thermal modification, thereby not only lowering the yield but also increasing the softening point of the pitch. Thus, a polymer having a high oxygen content cannot be practically used in the present invention. For this reason, it is preferred to use a reaction condition under which the polymer has low oxygen content. In the case where the polymer contains oxygen atoms, it can be free of oxygen before using as a pitch source by the dehydration.

The polymer thus prepared can be thermally modified by reaction at 380° to 460° C. for 0.5 to 10 hours and, thereafter, removing the light fraction by bubbling inert gas or by distillation under reduced pressure, whereupon an anisotropic pitch can be obtained. Alternatively the anisotropic pitch can be obtained by preforming the thermal modification simultaneously with removing the light fraction.

It is well known that in order to obtain high quality carbon fibers, it is necessary for pitch to have high anisotropy and to align the molecules parallel to the fiber axis at the stage of spinning. Additionally, it is advantageous that the molecule in the direction of the fiber axis is long in order to increase the strength of fibers.

For example, thermal modification of the compound of the present invention of the type that four or more xylenes are bound together through a methylene bond produces a relatively large amount of a quata type condensed ring structure resulting from cyclization through an alkyl side chain. Still another feature of the present invention is that since the alkyl group remains in fact to a certain extent even in the course of thermal modification, there is little interaction of the molecules although the condensed ring structure is readily formed. Accordingly, it is only when the starting material has a molecular structure as described above that the features of the present invention, i.e., a low softening point, a high anisotropy content, and a high strength and a high modulus of elasticity when converted into carbon fibers can be obtained.

In more detail, in order to obtain high quality carbon fibers, it is essential that molecules be orientated along the direction of the fiber axis while spinning, and it is desirable that anisotropy be high for the sake of greater orientation. For this reason, it is necessary for the anisotropy of the pitch to be not less than 85%, preferably not less than 90%, and more preferably not less than 95%. In general, the spinning temperature is the temperature to provide the viscosity necessary for spinning and is thought to be 40° to 100° C. higher than that of the softening point. Therefore, if the softening point is low, spinning can be carried out easily and, moreover, stably for a long period of time. However, if the softening point is too low, fibers leaving a nozzle are liable to fuse to each other and, thus, cannot be applied for practical use. With the pitch of the present invention, the softening point is 180° to 280° C., preferably 200° to 250° C. It is particularly preferred that the softening point is in the range of 200° to 250° C. because if the softening point is in this range, a raw fiber can be rendered infusible by air oxidation, without use of an expensive oxidizing agent such as ozone. An astonishing feature of the pitch which is prepared by using as a raw material the compound of formula (I) having four or more alkylbenzenes bound together through a methylene group and subjecting the raw material to thermal modification is that the softening point is 200° to 250° C. even if the optical anisotropy is 100%. Thus, the pitch of the present invention can be spun at temperatures as low as 250° to 300° C. and stably for a long period of time without degradation. Moreover, even if pitch is of 100% anisotropy, it can be stably spun without causing phase separation. If necessary, a pitch can be modified so that the softening point is not less than 280° C.

In order to increase the anisotropic structure and lower the softening point, it is necessary that the H/C (hydrogen/carbon atomic ratio) is in a suitable range though the H/C of the pitch can be changed in wide range. In the case that a dialkylbenzene is used as a starting material, the H/C of the pitch is desirable to be 0.60 to 0.75, preferably 0.65 to 0.70. Further, in the case that trialkylbenzene and tetraalkylbenzene are used, the H/C of their pitch is desirable to be 0.75 to 0.85, preferably 0.78 to 0.82. In this respect, the pitch of the present invention is completely different from the conventional mesophase pitch, because the H/C of the conventional mesophase pitch is 0.5 to 0.6. More astonishingly the pitch of the present invention is such that the toluene-insoluble content is small; in other words, the pitch of the present invention is defined as a toluene-soluble anisotropic pitch. The toluene-insoluble content can be controlled by the molecular weight of the polymer and thermal modification conditions. In order to increase anisotropy while keeping the softening point low, the toluene-insoluble content is not more than 50 wt %, preferably 20 to 40 wt %, and the quinoline-insoluble content is not more than 10 wt %, preferably not more than 3 wt %. Moreover, the anisotropic pitch of the present invention when mixed with the conventional mesophase pitch permits improvement of its pitch for spinning by lowering the softening point without decreasing the amount of anisotropy.

The present invention is described below in more detail by reference to the following examples although the present invention is not intended to be limited thereto.

EXAMPLE 1

270 g of a $C_9$ aromatic fraction (a 160° to 180° C. fraction of heavy reformate), 30 g of trioxane, and 50 g of a cation exchange resin were placed in a flask equipped with a stirring blade and a reflux condenser, which were then reacted at a temperature of 78 to 84° C. for 4 hours. After the reaction was completed, the catalyst was separated by filtration and then rinsed with 100 g of toluene. This toluene was added to the reaction mixture. This mixture was washed several times with purified water until the aqueous layer became neutral. Unreacted materials were removed by vacuum distillation (120° C./10 mmHg) to obtain 120 g of a polymer. The oxygen content of the polymer was 0.2 wt %.

Then, 60 g of the above prepared polymer was subjected to thermal modification under reflux at 390° C. in an inert gas atmosphere of nitrogen for 5 hours. Thereafter, nitrogen was bubbled into the reaction mixture at a rate of 400 cc/min at 400° C. in order to remove the light fraction and obtaining 7.2 g of a pitch. The properties of this pitch were as follows.

Optical anisotropy: 95%
Softening point: 220° C.
H/C: 0.81/1
Toluene-insoluble content: 30.3 wt %

The above pitch was melt-spun at a spinning temperature of 270° C. by the use of a spinning nozzle with a nozzle hole having a diameter of 0.5 mm. At a pitch fiber diameter of 15 μm, spinning could be carried out smoothly without thread breaking. These pitch fibers (original fibers) were made infusible by gradually raising the temperature finally to 300° C. in an air atmosphere. Then, the fibers were carbonized by calcining in an inert gas atmosphere up to 1,000° C. With the carbonized fibers thus obtained, the tensile strength was 2,160 MPa and the modulus of elasticity was 143 GPa. A part of the fibers was graphitized at 2,500° C. in an argon atmosphere. The tensile strength of the graphitized fibers was 4,210 MPa and the modulus of elasticity was 676 GPa.

EXAMPLE 2

300 g of a $C_{10}$ aromatic fraction (a 180 to 200° C. fraction of heavy reformate), 30 g of trioxane and 50 g of a cation exchange resin were placed in a flask and reacted in the same manner as in Example 1 to obtain 130 g of a polymer. The oxygen content of the polymer was 0.4 wt %. 60 g of the polymer was subjected to thermal modification in an inert gas atmosphere of nitrogen under reflux at 400° C. for 4 hours. Then, nitrogen was bubbled into the reaction mixture at a rate of 400 cc/min at 410° C. in order to remove a light fraction to obtain 6.2 g of a pitch. The properties of this pitch were as follows:

Optical anisotropy: 90%
Softening point: 230° C.
H/C: 0.80/1
Toluene-insoluble content: 35.0 wt %

The pitch was melt-spun at 280° C. by the use of a spinning nozzle with a nozzle hole having a diameter of 0.5 mm. At a pitch fiber diameter of 15 μm, spinning could be carried out without causing thread breaking. These fibers were made infusible by gradually raising the temperature finally to 300° C. in an air atmosphere, and then carbonized by calcining up to 1,000° C. in an inert gas atmosphere. With the carbonized fibers thus obtained, the tensile strength was 2,060 MPa and the modulus of elasticity was 137 GPa.

COMPARATIVE EXAMPLE 1

The oxygen content of a commercially available mesitylene-formaldehyde resin (trade name: Nikanol M) was analyzed and found to be 11.5 wt %. 100 g of the resin was subjected to thermal modification under the same conditions as in Example 1 to thereby remove a light fraction. In this way, 5 g of a black pitch was obtained. With this pitch, the anisotropy was 90%, but the softening point was 275° C. and the spinning temperature was 335° C.

EXAMPLE 3

550 g of xylene, 100 g of paraformaldehyde and 200 g of 83% sulfuric acid were placed in a flask equipped with a stirring blade and a reflux condenser, and reacted at a temperature of 110° C. for 5 hours. After the reaction was completed, the reaction mixture was diluted with 500 g of toluene, and the resulting mixture was washed with purified water until the aqueous layer became neutral. Then, unreacted compounds were removed by vacuum distillation (120° C./10 mmHg) and 300 g of a polymer was obtained. Thereafter, further vacuum distillation (240° C./1 mmHg) was applied to obtain 190 g of a distillate (polymer "A") and 110 g of a heavy substance as a still-bottom product. Elemental, GPC (gel permeation chromatography) and mass analyses showed that the above heavy substance was composed mainly of compounds containing four or more xylenes bound together through a methylene group.

60 g of the heavy substance was subjected to thermal modification under reflux at 420° C. for 7 hours in an inert atmosphere of nitrogen and then removed a light fraction by vacuum distillation (400° C./10 mmHg) for the purpose of converting into a mesophase pitch. In this way, 25.8 g of a pitch was obtained. The properties of the pitch thus obtained were as follows:

Optical anisotropy: 100%
Softening point: 225° C.
H/C: 0.670/1
Toluene-insoluble content: 38.2 wt %
Quinoline-insoluble content: 2.8 wt %

The pitch thus obtained was melt-spun at a spinning temperature of 270° C. by the use of a spinning nozzle with a nozzle hole having a diameter of 0.5 mm. At a pitch fiber diameter of 15 μm, spinning could be carried out smoothly without thread breaking. These pitch fibers (original fibers) were made infusible by gradually raising the temperature finally to 300° C. in an air atmosphere, and, thereafter, they were carbonized by calcining up to 1,000° C. in an inert gas atmosphere. With the carbon fibers thus obtained, the tensile strength was 1,790 MPa and the modulus of elasticity was 163 GPa.

EXAMPLES 4 AND 5

The procedure of Example 3 was repeated wherein conditions for preparation of the raw material and conditions for converting into a pitch were changed. The preparation conditions and properties of the raw materials are shown in Table 1, the preparation conditions and properties of the pitches are shown in Table 3, and the properties of the carbon fibers are shown in Table 4.

EXAMPLE 6

100 g of xylene, 100 g of a commercially available xylene-formalin resin, and 20 g of paratoluenesulfonic acid were placed in a flask equipped with a stirring blade and a reflux condenser, and then reacted at 120° C. for 5 hours. After the reaction was completed, the reaction mixture was diluted with 300 g of toluene, and the resulting mixture was washed with purified water until the aqueous layer became neutral. Then, the mixture was subjected to vacuum distillation (240° C./1 mmHg) to obtain 140 g of a heavy substance as a still-bottom product. Elemental, GPC and mass analyses showed that the above heavy substance was a fraction of four or more xylenes bound together through a methylene group. The oxygen content of the fraction was 0.4 wt %.

60 g of the above heavy substance was subjected to thermal modification for 8 hours under reflux at 400° C. in an inert atmosphere of nitrogen. Then, nitrogen was bubbled into the reaction mixture at a rate of 400 cc/min at 400° C. in order to remove the light fraction, and 24.0 g of a pitch was obtained. The optical properties of this pitch were as follows:

Optical anisotropy: 90%
Softening point: 235° C.
H/C: 0.668/1
Toluene-insoluble content: 39.2 wt %
Quinoline-insoluble content: 9.0 wt %

The above pitch was melt-spun at 290° C. by the use of a spinning nozzle with a nozzle hole having a diameter of 0.5 mm. At a pitch fiber diameter of 13 μm, spinning could be carried out smoothly without thread breaking. These fibers were made infusible by gradually raising the temperature finally to 300° C. in an air atmosphere, and, thereafter, carbonized by calcining up to 1,000° C. in an inert gas atmosphere. With the carbon fibers thus obtained, the tensile strength was 1,740 MPa and the modulus of elasticity was 162 GPa.

The preparation conditions and properties of the raw material are shown in Table 2, the preparation conditions and properties of the pitch are shown in Table 3, and the properties of the carbon fibers are shown in Table 4.

EXAMPLE 7

The procedure of Example 6 was repeated wherein the conditions for preparation of the raw material and the conditions for converting into the pitch were changed. The preparation conditions and properties of the raw material are shown in Table 2, and the preparation conditions and properties of the pitch are shown in Table 3.

EXAMPLE 8

240 g of a $C_9$ aromatic fraction (a 160° to 180° C. fraction of heavy reformate), 45 g paraldehyde and 50 g cation exchange resin (Amberlist 15) were placed in a flask equipped with a stirring blade and a reflux condenser, and reacted at a temperature of 75° to 85° C. for 4 hours. After the reaction was completed, the catalyst was separated by filtration and then rinsed with 100 g of toluene. The toluene was added to the reaction mixture. This mixture was washed with purified water until the aqueous layer became neutral. Then, unreacted compounds were removed by vacuum distillation (120° C./10 mmHg) and 126 g of a polymer was obtained. Thereafter, further vacuum distillation (240° C./1 mmHg) was applied to obtain 76 g of a distillate and 50 g of a heavy substance as a still-bottom product. The oxygen content of the still-bottom product was 1.2 wt %.

50 g of the heavy substance was subjected to thermal modification under reflux at 400° C. for 6 hours in an inert gas atmosphere of nitrogen and then removed the light fraction by vacuum distillation (400° C./10 mmHg) for the purpose of converting into a mesophase pitch. 10.5 g of a pitch was obtained. The properties of this pitch were as follows:

Optical anisotropy: 90%
Softening point: 250° C.
H/C: 0.760/1
Toluene-insoluble: 47.5
Quinoline-insoluble: 12.5

The pitch was melt-spun at 310° C. by the use of a spinning nozzle with a nozzle hole having a diameter of 0.5 mm. At a pitch fiber diameter of 15 μm, spinning could be carried out without thread cutting. The pitch fibers (original fibers) were made infusible by gradually raising the temperature finally to 300° C. in an air atmosphere, and then carbonized by calcining up to 1,000° C. in inert gas atmosphere. With the carbonized fibers thus obtained, the tensile strength was 1,680 MPa and the modulus of elasticity was 145 GPa.

COMPARATIVE EXAMPLE 2

The oxygen content of a commercially available xylene-formalin resin (trade name: Nikanol L) was analyzed and found to be 8.8 wt. %.

100 g of the above xylene-formalin resin was reacted for 7 hours under reflux at 400° C. in an inert atmosphere of nitrogen and then removed the light fraction by vacuum distillation (400° C./10 mmHg) for the purpose of converting into a mesophase pitch. The yield of the pitch was only 2.0 g. The properties of this pitch were as follows.

Optical anisotrophy: 90%
Softening point: 300° C.
Toluene-insoluble content: 66.0 wt. %
Quinoline-insoluble content: 35.0 wt. %
Spinning properties: impossible to spin The preparation conditions and properties of the pitch are shown in Table 3.

COMPARATIVE EXAMPLE 3

500 g of a xylene dimer and trimer fraction (polymer "A" in Example 3) was subjected to thermal modification for 12 hours under reflux at 400° C. in an inert atmosphere of nitrogen and then removed the light fraction by vacuum distillation (400° C./10 mmHg) for the purpose of converting into a mesophase pitch. The yield of the pitch was only 10.0 g. The properties of this pitch are shown in Table 3.

COMPARATIVE EXAMPLE 4

A pitch was produced from the catalytic cracker residue having a boiling point higher than 400° C. in the same thermal modification condition as in Example 3. The properties of this pitch were as follows:

Optical anisotropy: 90%
Softening point: 280° C.
H/C: 0.58/1

The above pitch was melt-spun at 350° C. by the use of a spinning nozzle with a nozzle hole having a diameter of 0.5 mm. At a pitch fiber diameter of 13 μm, spinning could be carried out smoothly without thread breaking. These pitch fibers were made infusible by gradually raising the temperature finally to 300° C. in an air atmosphere and then carbonized by calcining at a temperature up to 1,000° C. in an inert gas atmosphere. With the carbon fibers thus obtained, the tensile strength was 1,600 MPa and the modulus of elasticity was 134 GPa.

TABLE 1

| Example No. | Reactant | Catalyst | Reaction Temperature (°C.) | Time (hrs) | Yield* (wt %) | Elemental Analysis C (wt %) | H (wt %) | O (wt %) |
|---|---|---|---|---|---|---|---|---|
| Example 3 | Xylene/paraformaldehyde | 83% $H_2SO_4$ | 110 | 5 | 20 | 91.8 | 8.1 | 0.1 |
| Example 4 | Xylene/trioxane | Amberlist 15 | 100 | 8 | 15 | 91.3 | 8.6 | 0.1 |
| Example 5 | Xylene/paraformaldehyde | 80% Pyrophosphoric acid | 100 | 4 | 17 | 90.0 | 9.0 | 1.0 |

Note:
*Yield: Based on xylene.

TABLE 2

| Example No. | Reactant | Catalyst | Reaction Temperature (°C.) | Time (hrs) | Yield* (wt %) | Elemental Analysis C (wt %) | H (wt %) | O (wt %) |
|---|---|---|---|---|---|---|---|---|
| Example 6 | Xylene/xylene-formalin resin | PTS** | 120 | 5 | 70 | 91.5 | 8.1 | 0.4 |
| Example 7 | Xylene/xylene-formalin resin | 75% $H_2SO_4$ | 110 | 6 | 82 | 91.7 | 7.8 | 0.5 |

Note:
*Yield: Based on the reactant.
**Paratoluenesulfonic acid

TABLE 3

| Example No. | Conditions for Thermal Modification | Conditions for Formation of Pitch | Yield (wt %) | Quinoline-Insoluble Content (wt %) | Toluene-Insoluble Content (wt %) | Anisotropy (%) | Softening Point (°C.) | Atomic Ratio (H/C) |
|---|---|---|---|---|---|---|---|---|
| Example 3 | 420° C. × 7 hrs | 400° C. × 10 mmHg | 43 | 2.8 | 38.2 | 100 | 225 | 0.670 |
| Example 4 | 430° C. × 4 hrs | 400° C. × 10 mmHg | 37 | 0.0 | 31.7 | 100 | 215 | 0.685 |
| Example 5 | 410° C. × 10 hrs | 400° C. × 0.5 hrs* | 35 | 5.4 | 43.0 | 100 | 240 | 0.705 |
| Example 6 | 400° C. × 8 hrs | 400° C. × 0.5 hrs* | 40 | 9.0 | 39.2 | 90 | 235 | 0.668 |
| Example 7 | 420° C. × 6 hrs | 400° C. × 10 mmHg | 30 | 8.5 | 43.8 | 95 | 245 | 0.660 |
| Comparative Example 2 | 400° C. × 7 hrs | 400° C. × 10 mmHg | 2 | 35.0 | 66.0 | 90 | 300 | 0.620 |
| Comparative Example 3 | 400° C. × 12 hrs | 400° C. × 10 mmHg | 2 | 1.0 | 32.1 | 90 | 215 | 0.680 |

Note: *$N_2$ stripping

TABLE 4

| Example No. | Fiber Diameter (μm) | Tensile Strength (MPa) | Modulus of Elasticity (GPa) |
|---|---|---|---|
| Example 3 | 13.5 | 1,790 | 163 |
| Example 4 | 10.6 | 1,860 | 173 |
| Example 5 | 10.9 | 1,730 | 168 |
| Example 6 | 11.3 | 1,740 | 162 |
| Comparative Example 4 | 10.5 | 1,600 | 134 |

(All 1,000° C. carbonized products)

The pitch as used in the present invention can be easily and stably spun at a much lower temperature than the conventional coal or petroleum-based pitch although the pitch of the present invention is of high anisotropy. Moreover, the pitch of the present invention contains only small amounts of impurities such as ash and sulfur which produce defects in the final fibers. Thus, the pitch of the present invention possesses excellent properties as a pitch for production of carbon fibers and permits production of carbon fibers of high tensile strength and high modulus of elasticity.

While the invention has been described in detail and with reference to specific embodiments thereof, it will be apparent to one skilled in the art that various changes and modifications can be made therein without departing from the spirit and scope thereof.

What is claimed is:

1. A pitch having optical anisotrophy for use in production of carbon fibers, wherein said pitch is parepared from a starting material consisting essentially of a compund represented by formula (I):

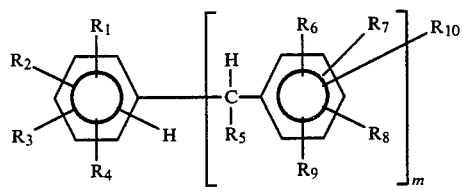

(I)

wherein $R_1$, $R_2$, $R_3$, $R_4$, $R_6$, $R_7$, $R_8$, $R_9$, and $R_{10}$ each represents a hydrogen atom or a methyl group or an ethyl group; $R_5$ represents a hydrogen atom or a methyl group; the total number of carbon atoms of $R_1$, $R_2$, $R_3$ and $R_4$ is from 2 to 4 and the total number of carbon atoms of $R_6$, $R_7$, $R_8$ and $R_9$ is from 2 to 4; and m is at least 3, the process of preparing said pitch comprising heating said compound at a temperature of 380° to 450° C. for 0.5 to 10 hours and then removing a light fraction which is formed by means of vacuum distillation or inert gas bubbling wherein said pitch has an optical anisotrophy of at least 85%, a softening point of 180° C. to 290° C., and a toluene insoluble content of not more than 50 wt. %.

2. A pitch as claimed in claim 1, wherein said pitch has an optical anisotropy of at least 85%, a softening point of 200° C. to 250° C., a toluene-insoluble content of not more than 50 wt %, and a quinoline-insoluble content of not more than 10 wt %.

3. A pitch as claimed in claim 1, wherein said pitch has an optical anisotropy of at least 95%, a softening point of 200° C. to 250° C., a toluene-insoluble content of 20 to 40 wt %, and a quinoline-insoluble content of not more than 3 wt %.

4. A pitch having optical anisotropy for use in production of carbon fibers, wherein said pitch is prepared by polymerizing: (a) an alkylbenzene substituted by 2 to 4 methyl groups or ethyl groups or a mixture thereof, and (b) formaldehyde or acetaldehyde in the presence of a catalyst of protonic acid to prepare an alkylbenzene-polymer, and then heating the alkylbenzene-polymer at a temperature of 380° to 450° C. for 0.5 to 10 hours and removing a light fraction which is formed by means of vacumm distillation or inert gas bubbling, wherein said pitch has an optical anisotrophy of at least 85%, a softening point of 180° C. to 280° C., and a toluene insoluble content of not more than 50 wt %.

5. An alkylbenzene-polymer as claimed in claim 4, wherein said polymer has an oxygen content of not more than 5 wt %.

6. An alkylbenzene-polymer as claimed in claim 4, wherein said polymer has an oxygen content of not more than 2 wt %.

7. An alkylbenzene-polymer as claimed in claim 4, wherein said polymer has an oxygen content of not more than 1 wt %.

8. A pitch as claimed in claim 4, wherein said pitch has an optical anisotropy of at least 95%, a softening point of 200° C. to 250° C., and a toluene-insoluble content of 20 to 40 wt %.

9. A pitch as claimed in claim 4, wherein said pitch which is prepared from a dialkylbenzene as starting material has an H/C (hydrogen/carbon atomic ratio) of 0.60 to 0.75.

10. A pitch as claimed in claim 4, wherein said pitch which is prepared from a dialkylbenzene as starting material has an H/C (hydrogen/carbon atomic ratio) of 0.65 to 0.70.

11. A pitch as claimed in claim 4, wherein said pitch which is prepared from a trialkylbenzene or tetraalkylbenzene as starting material has an H/C (hydrogen/carbon atomic ratio) of 0.75 to 0.85.

12. A pitch as claimed in claim 4, wherein said pitch which is prepared from a trialkylbenzene or tetraalkylbenzene as starting material has an H/C (hydrogen/carbon atomic ratio) of 0.78 to 0.82.

13. A pitch having optical anisotropy for use in production of carbon fibers, wherein said pitch is prepared by polymerizing (a) a benzene derivative substituted by 2 to 4 methyl groups and/or ethyl groups or a mixture thereof, and (b) a xylene-formalin resin or a mesitylene-formalin resin in the presence of a catalyst of protonic acid to prepare and alkylbenzene-polymer, and then heating the alkylbenzene-polymer at a temperature of 380° to 450° C. for 0.5 to 10 hours and removing a light fraction which is formed by means of vacuum distillation or inert gas bubbling, wherein said pitch has an optical anisotropy of at least 85%, a softening point of 180° C. to 280° C., and a toluene insoluble content of not more than 50 wt %.

14. An alkylbenzene-polymer as claimed in claim 13, wherein said polymer has an oxygen content of not more than 5 wt %.

15. An alkylbenzene-polymer as claimed in claim 13, wherein said polymer has an oxygen content of not more than 2 wt %.

16. An alkylbenzene-polymer as claimed in claim 13, wherein said polymer has an oxygen content of not more than 1 wt %.

17. A pitch as claimed in claim 13, wherein said pitch has an optical anisotropy of at least 95%, a softening point of 200° C. to 250° C., and a toluene-insoluble content of 20 to 40 wt %.

18. A pitch as claimed in claim 13, wherein said pitch which is prepared from a dialkylbenzene as starting material has an H/C (hydrogen/carbon atomic ratio) of 0.60 to 0.75.

19. A pitch as claimed in claim 13, wherein said pitch which is prepared from a dialkylbenzene as starting material has an H/C (hydrogen/carbon atomic ratio) of 0.65 to 0.70.

20. A pitch as claimed in claim 13, wherein said pitch which is prepared from a trialkylbenzene or tetraalkylbenzene as starting material has an H/C (hydrogen/carbon atomic ratio) of 0.75 to 0.85.

21. A pitch as claimed in claim 13, wherein said pitch which is prepared from a trialkylbenzene or tetraalkylbenzene as starting material has an H/C (hydrogen/carbon atomic ratio) of 0.78 to 0.82.

* * * * *